US009247836B2

(12) United States Patent
DuPré

(10) Patent No.: US 9,247,836 B2
(45) Date of Patent: Feb. 2, 2016

(54) CONFIGURABLE PILLOW CASE WITH A COMPARTMENT FOR AT LEAST ONE REMOVABLE INSERT

(71) Applicant: Michelle DuPré, Brooklyn, NY (US)

(72) Inventor: Michelle DuPré, Brooklyn, NY (US)

( * ) Notice: Subject to any disclaimer, the term of this patent is extended or adjusted under 35 U.S.C. 154(b) by 0 days.

(21) Appl. No.: 14/144,466

(22) Filed: Dec. 30, 2013

(65) Prior Publication Data

US 2014/0196214 A1 Jul. 17, 2014

Related U.S. Application Data

(60) Provisional application No. 61/747,272, filed on Dec. 29, 2012.

(51) Int. Cl.

| | |
|---|---|
| ***A47G 9/02*** | (2006.01) |
| ***A47G 9/10*** | (2006.01) |
| *A47G 9/00* | (2006.01) |

(52) U.S. Cl.

CPC ..... *A47G 9/0253* (2013.01); *A47G 9/1045* (2013.01); *A47G 9/1081* (2013.01); *A47G 2009/003* (2013.01); *A47G 2009/005* (2013.01); *A47G 2009/006* (2013.01)

(58) Field of Classification Search

CPC ..... A47G 9/10; A47G 9/1045; A47G 9/1009; A47G 2009/003; A47G 9/02; A47G 9/0253

USPC ..... 5/636, 639, 640, 643–645, 485, 490, 5/728

See application file for complete search history.

(56) References Cited

U.S. PATENT DOCUMENTS

| | | | | |
|---|---|---|---|---|
| 4,365,371 | A * | 12/1982 | Boussaroque | 5/728 |
| 4,754,513 | A * | 7/1988 | Rinz | 5/490 |
| 4,959,880 | A * | 10/1990 | Tesch | 5/636 |
| 5,474,362 | A * | 12/1995 | Albecker, III | 297/452.32 |
| 5,632,051 | A * | 5/1997 | Stanley et al. | 5/636 |
| 5,948,013 | A * | 9/1999 | Swezey et al. | 607/108 |
| 6,805,076 | B2 * | 10/2004 | Duffy et al. | 119/650 |
| 7,735,169 | B2 * | 6/2010 | Wassilefsky | 5/636 |
| 2004/0019972 | A1 * | 2/2004 | Schecter et al. | 5/645 |
| 2008/0235877 | A1 * | 10/2008 | Murray et al. | 5/640 |
| 2009/0211030 | A1 * | 8/2009 | Norstrem | 5/640 |
| 2012/0073056 | A1 * | 3/2012 | Freund et al. | 5/639 |
| 2013/0232695 | A1 * | 9/2013 | Koci | 5/640 |

* cited by examiner

*Primary Examiner* — Robert G Santos
*Assistant Examiner* — Myles Throop
(74) *Attorney, Agent, or Firm* — Edward Etkin, Esq.

(57) ABSTRACT

The present invention is directed, in various exemplary embodiments thereof, to an inventive configurable pillow case comprising an internally disposed primary compartment (for receiving a primary insert (e.g., a conventional pillow), and at least one secondary compartment, positioned proximally to the pillow case top surface, that is sized and configured to receive, and releaseably retain, one or more correspondingly sized and configured secondary inserts that provide one or more predefined desirable physical characteristics/properties/functions and/or features to the resulting "pillow assembly". In various exemplary embodiments thereof, when the primary resilient insert is removed therefrom, the inventive configurable pillow case, along with the at least one secondary insert positioned in the at least one secondary compartment, may be rolled up and secured in a generally cylindrical form for storage, travel, and/or alternative uses.

9 Claims, 6 Drawing Sheets

CONFIGURABLE PILLOW CASE WITH A COMPARTMENT FOR AT LEAST ONE REMOVABLE INSERT

CROSS REFERENCE TO RELATED APPLICATIONS

The present application claims priority form the commonly assigned U.S. Patent Application Ser. No. 61/747,272 filed on Dec. 29, 2012, which is hereby incorporated herein by reference in its entirety.

FIELD OF THE INVENTION

The present invention relates generally to articles for use with pillows and equivalent resilient products, and more particularly to modular configurable pillow cases operable to enable the use, in conjunction with a pillow (or equivalent product) inserted therein, of one or more resilient components that provide one or more predefined desirable physical characteristics/properties (such as, for example memory foam capabilities) to a resulting "configurable pillow case assembly", that add to, augment, enhance, and/or otherwise supplement, the characteristics/properties offered by the inserted pillow, that are usable/operable to add to, augment, enhance, and/or otherwise supplement, the characteristics/properties offered by the inserted pillow, and that are configurable to further provide one or more additional functions and features.

BRIEF DESCRIPTION OF THE DRAWINGS

In the drawings, wherein like reference characters denote corresponding or similar elements throughout the various figures:

FIG. 1D-2 is a schematic isometric view diagram of the exemplary embodiment of the inventive configurable pillow case of FIG. 1D-1, shown, by way of example only, in its rolled-up mode, and positioned within an optional outer housing (which may be a suitably sized sleeve, bag, case or equivalent);

SUMMARY OF THE INVENTION

Figure 1A:
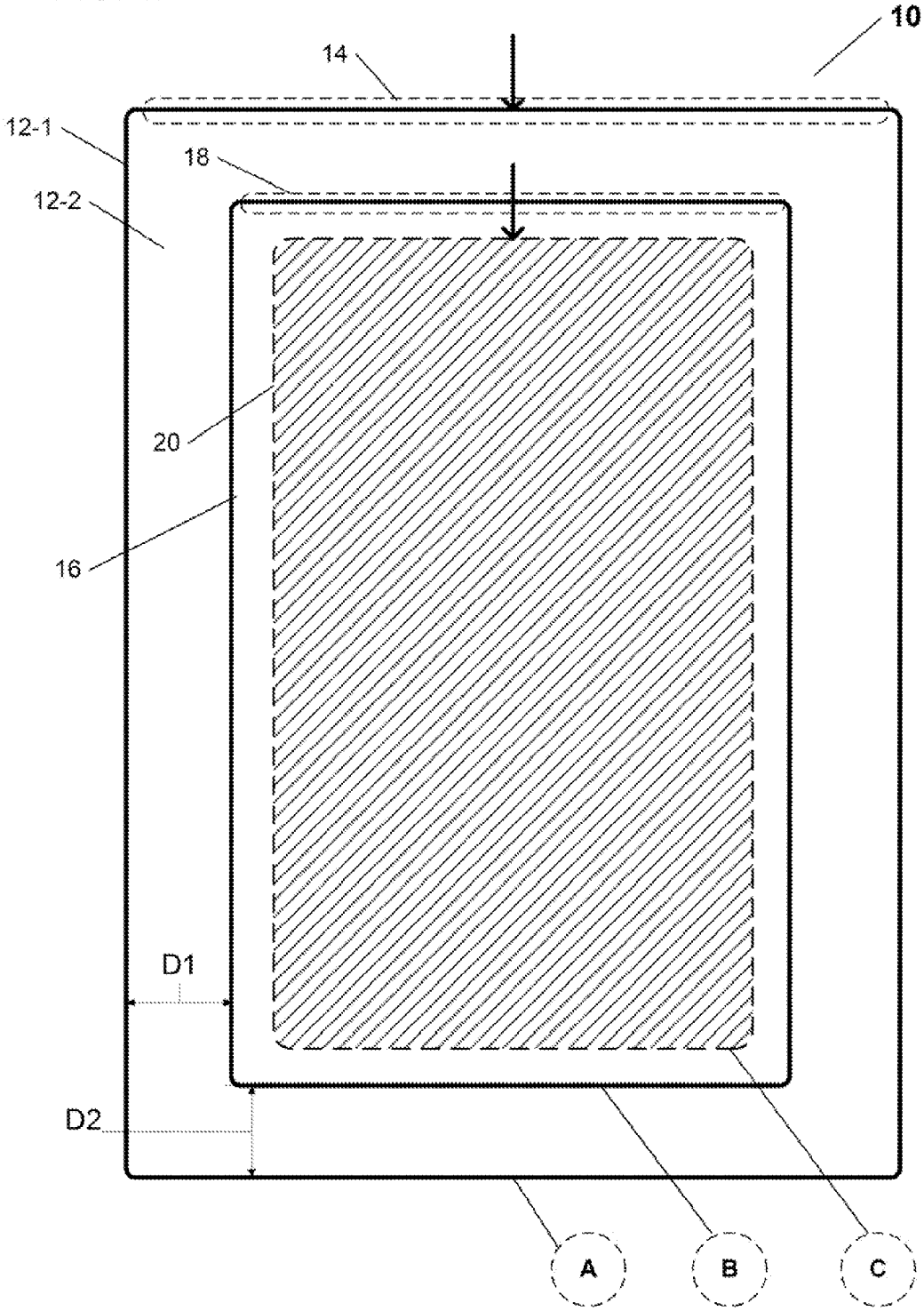
FIG. 1A is a schematic top-down view diagram of a first exemplary embodiment of the inventive configurable pillow case, with an internally disposed primary compartment, and a secondary compartment positioned on the pillow case top surface, operable for being utilized in conjunction with any primary insert component (such as an appropriately sized conventional pillow (or equivalent similarly shaped soft and/or resilient article)), that may be positioned in its primary compartment, and further operable to receive and retain, in the secondary compartment, at least one secondary insert component (such as a memory foam, latex, resilient material filled, inflatable, or other type of resilient article)

The present invention addresses and resolves all of the disadvantages of the previously known pillow cases, as well as of most travel and/or specialty pillow products, by providing, in various exemplary embodiments thereof, an inventive configurable pillow case comprising an internally disposed primary compartment (for receiving a primary resilient insert component (e.g., a conventional pillow or equivalent), and at least one secondary compartment, positioned proximally to (e.g., above and/or below) the pillow case top surface, that is sized and configured to receive, and releaseably retain therein, one or more correspondingly sized and configured secondary insert component(s) that are each operable to provide one or more predefined desirable physical characteristics/properties to the resulting "pillow assembly" (such as memory foam region as a "topper" to a conventional pillow), and/or that add to, augment, enhance, and/or otherwise supplement, the characteristics/properties offered by the primary resilient insert, and that are configurable to further provide one or more additional functions and features (including, by way of example, "technological" functions/features, such as noise cancellation, ambient music playback, alarms, lighting, etc.).

Advantageously, in various exemplary embodiments of the inventive configurable pillow case, when the primary resilient insert is removed therefrom, the inventive configurable pillow case may be readily rolled up, and releaseably secured in, a substantially cylindrical form readily suitable for transport, storage, travel, and for various alternative uses (such as a lumbar and/or neck support pillow).

Furthermore, the various exemplary embodiments of the present invention may readily and advantageously utilize any number and/or combination of wide variety of possible secondary insert components, that each provide one or more specific beneficial/desirable characteristics, properties, functions, and/or features to the configurable pillow case assembly.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DETAILED DESCRIPTION OF PREFERRED EMBODIMENTS

In various exemplary embodiments thereof, the configurable pillow case of the present invention addresses and resolves all of the flaws and drawbacks of previously known pillow cases (and especially in the context of utilization of 3rd party/public pillow cases (such as in 3rd party residences, hotels, hospitals, etc.), as well as the drawbacks, flaws, and deficiencies of most travel and/or specialty pillow products, while at the same time providing significant additional benefits and advantages.

The present invention is directed to modular configurable pillow cases operable to enable the use, in conjunction with a pillow (or equivalent product) inserted therein, of one or more resilient components that provide one or more predefined desirable physical characteristics/properties (such as, for example memory foam capabilities) to a resulting "configurable pillow case assembly", that are usable/operable to add to, augment, enhance, and/or otherwise supplement, the characteristics/properties offered by the inserted pillow, and that are optionally configurable to further provide the configurable pillow case assembly with one or more additional selectively operable and/or automated functions and features.

Referring now to FIG. 1A, a schematic top-down view diagram of a first exemplary embodiment of the inventive configurable pillow case, is shown as a configurable pillow case 10, comprising a housing 12-1 of a size A, with an internally disposed primary compartment 12-2, accessible through an opening 14, that is sized and configured to receive, and releaseably retain therein, a primary insert component (not shown) such as a conventional pillow (or equivalent similarly shaped soft and/or resilient article), and further comprising a secondary compartment 16 of a size B positioned on the pillow case housing 12-1 top surface at distances D1, D2 from the outer edges thereof, that is operable to receive and releaseably retain therein, at least one secondary insert component 20 of a size C (shown by way of example only, as a single insert component), which may comprise at least one of the following materials: memory foam, latex foam, memory gel, gel, fluid, a granular mixture, at least one inflateable air bladder, a rubberized component, a selectively shapeable material component (for example, pluckable soft foam), a feather filled component, a down filled component, and/or a resilient material component or assembly.

In accordance with the present invention, the relative sizes A, B, and C, and the distances D1, D2, may be selected as a matter of design choice or convenience without departing from the spirit of the invention. In one embodiment of the present invention in which the configurable pillow case 10 is sized and configured for use with conventionally sized sleeping pillows, the value of secondary component 16 size B is preferably substantially equals or exceeds the value of the pillow case housing 12-1 size A.

Figure 1B:
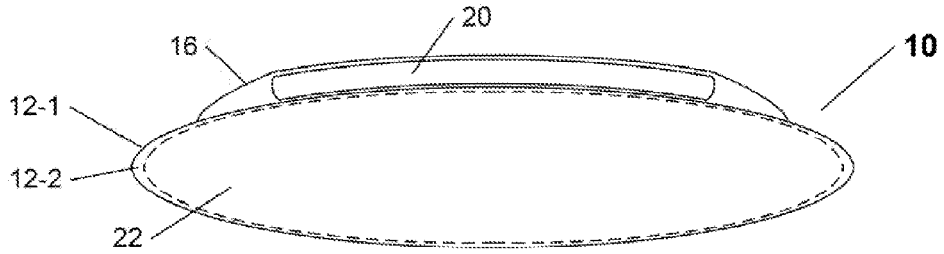
FIG. 1B is a schematic side view diagram of the exemplary embodiment of the inventive configurable pillow case of FIG. 1A, shown, by way of example only, an exemplary primary insert component (e.g., a pillow) positioned in the configurable pillow case primary compartment, and showing an exemplary secondary insert component; positioned in the secondary compartment.

Referring now to FIG. 1B, a schematic side view diagram of the configurable pillow case 10 of FIG. 1A is shown by way of example only, with an exemplary primary insert component (e.g., a pillow) 22 positioned in the configurable pillow case primary compartment 12-2, and the exemplary secondary insert component 20; positioned in the secondary compartment 16.

Figure 1C:
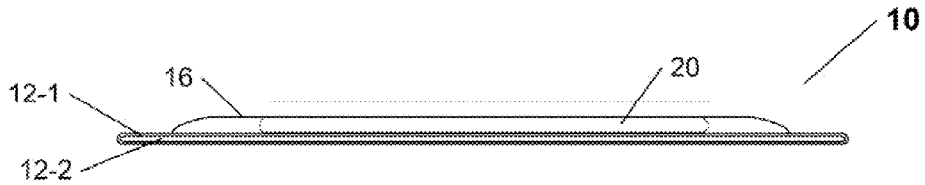
FIG. 1C is an alternative schematic side view diagram of the exemplary embodiment of the inventive configurable pillow case of FIGS. 1A and 1B, shown, by way of example only, with an empty configurable pillow case primary compartment, and showing the exemplary secondary insert component; positioned in the secondary compartment.

Referring now to FIG. 1C, a schematic side view diagram of the configurable pillow case 10 of FIG. 1A is shown by way of example only, with an empty primary compartment 12-2, and with the exemplary secondary insert component 20 being positioned in the secondary compartment 16.

Figures 1, 1D:
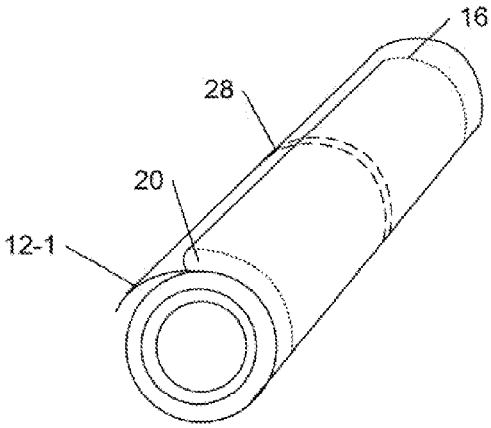
FIG. 1D-1 is a schematic isometric view diagram of the exemplary embodiment of the inventive configurable pillow case of FIG. 1C, shown, by way of example only, in a "rolled-up" mode suitable for transport, storage, travel, and various alternative uses, with an optional releasable securing element operable to maintain the inventive configurable pillow case in the rolled-up mode.

Referring now to FIG. 1D-1, a schematic isometric view diagram of the configurable pillow case 10 of FIG. 1A is shown, by way of example only, in a "rolled-up" mode suitable for transport, storage, travel, and for various alternative uses (such as a bolster, lumbar, and/or neck support pillow). Optionally, the configurable pillow case 10 further includes at least one releasable securing element 28 (e.g., an elastic or other type of a band or a strap operable to maintain the inventive configurable pillow case 10 in the rolled-up mode.

Figures 1, 1D, 2:
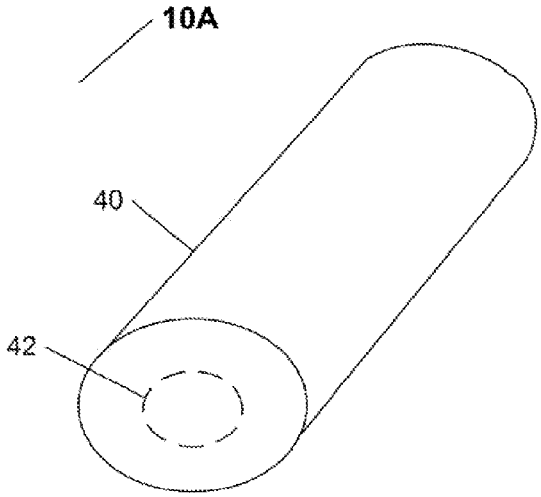

Referring now to FIG. 1D-2, a schematic isometric view diagram of the configurable pillow case 10 rolled up mode view of FIG. 1D-1 is shown, by way of example only, as positioned within an optional outer housing 40 (which may be a suitably sized sleeve, bag, case or equivalent), which may include an optional securing element 42, such as a drawstring or other type of closure (zipper, etc.) operable to retain the rolled up configurable pillow case 10 within the outer housing 40.

Figure 2A:
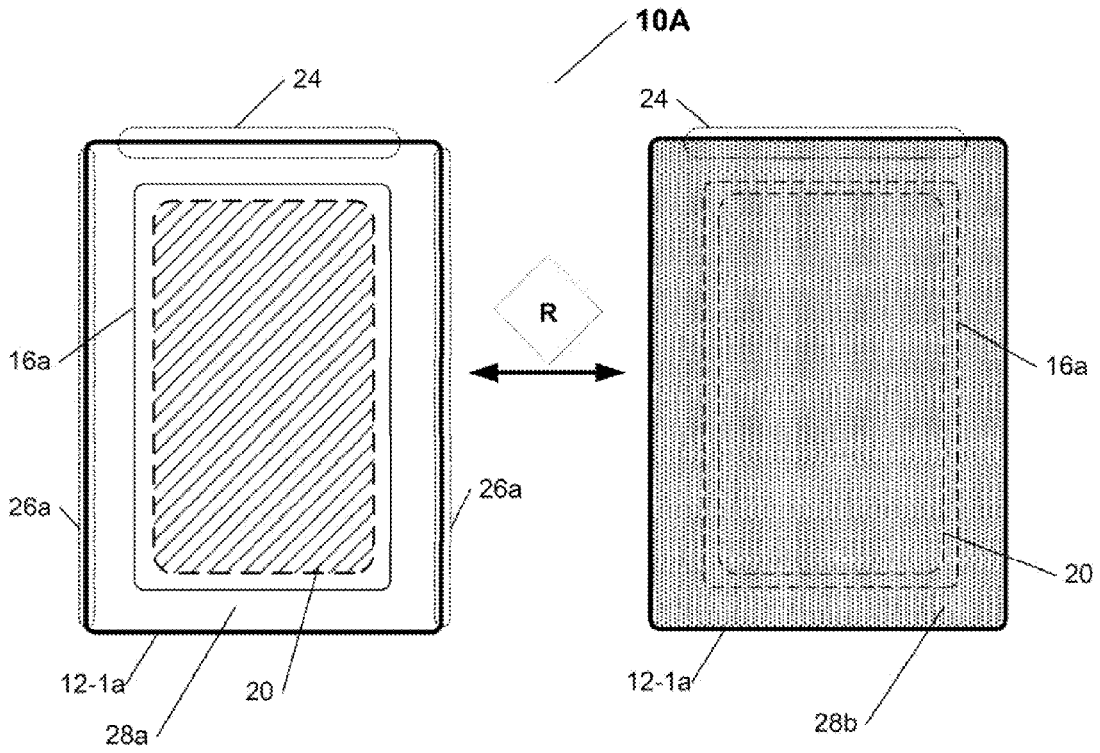
FIG. 2A is a schematic top-down view diagram of a first alternative embodiment of the inventive configurable pillow case of FIG. 1A, that is further configured to be capable of reversible operation (with or without optional selectively operable reversibility facilitating elements) such that in a "reversed" mode of operation, the novel configurable pillow case is configured such that its primary compartment inner surfaces comprise the pillow case outer surfaces, while the pillow case outer surfaces comprise the inner surfaces of a newly formed primary compartment, and such that the secondary compartment is positioned inside the newly formed primary compartment, underneath the pillow case top surface.

Referring now to FIG. 2A, a schematic top-down view diagram of a first alternative embodiment of the inventive configurable pillow case 10 of FIG. 1A, is shown as a configurable pillow case 10A with a housing 12-1*a* that comprises a first lining 28*a*, suitable for a first category of configurable pillow case 10A use (such as for sleeping thereon), and a second lining 28*b*, suitable for a secondary category of configurable pillow case 10A use (such as for transporting, for utilization in a rolled up mode, etc.), which may comprise a protective/rugged material, such as nylon, polyester, etc. Advantageously, the configurable pillow case 10A is further configured to be capable of reversible operation R either by inversion (or by using optional selectively operable reversibility facilitating elements 26*a* (such as side zippers or equivalent) such that in a "reversed" mode of operation, the novel configurable pillow case 10A is configured such that its primary compartment inner surface 28*b* comprises the pillow case 10A outer surface, while the pillow case outer surface 28*a* comprises the inner surface of a newly formed primary compartment, and such that the secondary compartment 16*a* is positioned inside the newly formed primary compartment, underneath the pillow case 10A new top surface 28*b*.

Figure 2B:
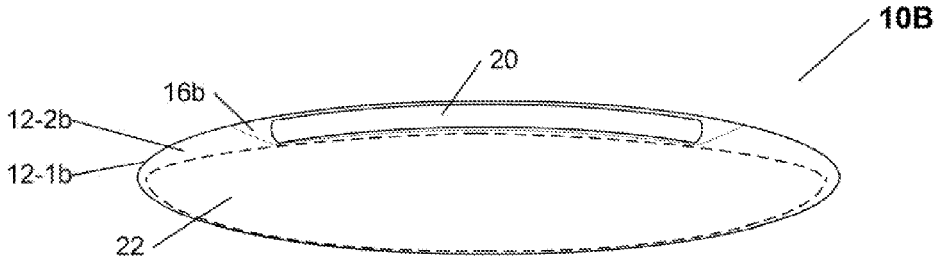
FIG. 2B is a schematic side-view diagram of a second alternative embodiment of the inventive configurable pillow case of FIGS. 1A and 1B, in which the secondary compartment is positioned within the primary compartment below the top outer surface of the novel configurable pillow case, so as to enable the inventive configurable pillow case to aesthetically appear as a conventional pillow case, and is also a schematic side-view diagram of the inventive configurable pillow case of FIG. 2A, shown in its reversed mode of operation, with an exemplary primary insert component positioned in the primary compartment.

Referring now to FIG. 2B, a schematic side-view diagram of a second alternative embodiment of the inventive configurable pillow case 10 of FIGS. 1A and 1B, is shown as a configurable pillow case 10B with components 12-1*b*, 12-2*b*, 16*b*, 20 and 22, in which the secondary compartment 16*b* is positioned within the primary compartment 12-2*b*, below the top outer surface of the novel configurable pillow case 12-1*b*, so as to enable the inventive configurable pillow case 10B to aesthetically appear as a conventional pillow case even when an exemplary primary insert component 20 is placed therein, above the compartment with the pillow 22. This FIG. 2B also illustrates the inventive configurable pillow case 10A of FIG. 2A, in its reversed (inverted) mode of operation, with the insert component 20 positioned in the primary compartment.

Figure 3A:
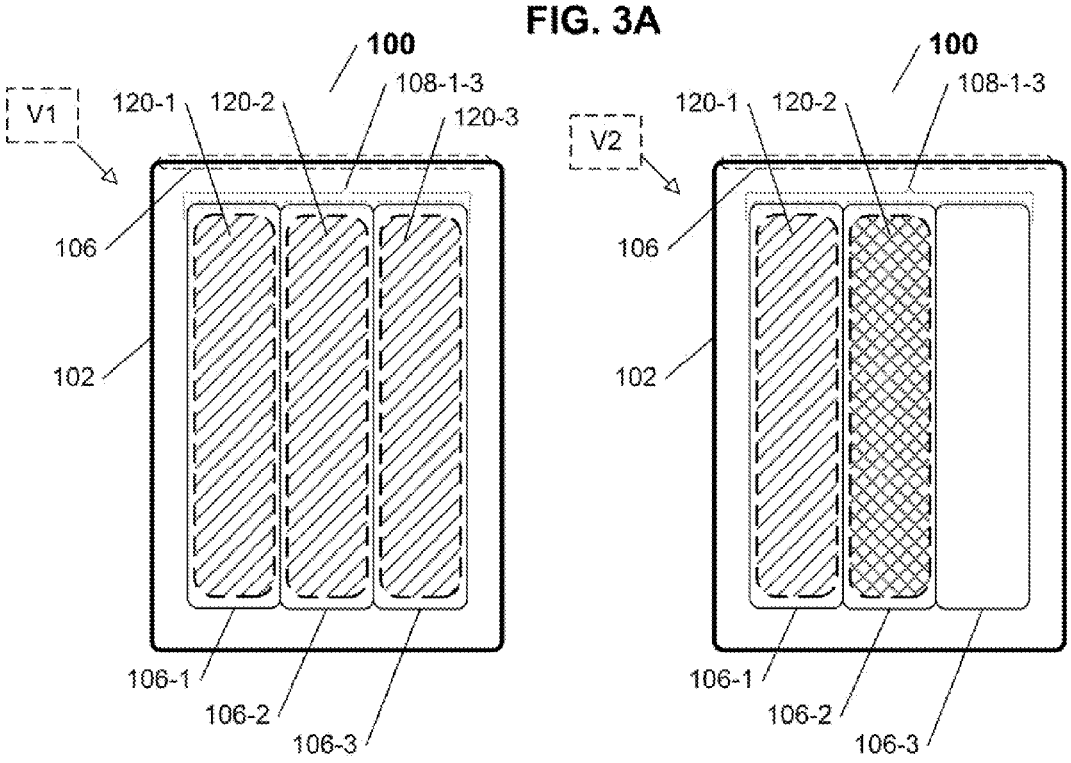
FIG. 3A is a schematic top-down view diagram of a second exemplary embodiment of the inventive configurable pillow case, with an internally disposed primary compartment, and a secondary compartment region positioned on the pillow case top surface, comprising a plurality of individual proximally disposed secondary compartments (at least two, with three being illustrated by way of example only) positioned therein, with the primary compartment being operable to receive and releaseably retain therein any primary insert component (such as an appropriately sized conventional pillow (or equivalent similarly shaped soft and/or resilient article)), and with each plural secondary compartment being selectively operable to receive, and retain therein, at least one corresponding secondary insert component (such as a memory foam, latex, resilient material filled, inflatable, or other type of resilient article), wherein: in a view V1, all three exemplary plural secondary compartments are shown, by way of example, with corresponding plural secondary inserts disposed therein; and in a view V2, the three exemplary plural secondary compartments are shown, by way of example, with corresponding plural secondary inserts disposed in only two of the three plural secondary compartments.

Referring now to FIG. 3A, a schematic top-down view diagram of a second exemplary embodiment of the inventive configurable pillow case, is shown as a configurable pillow case 100, with an internally disposed primary compartment 102, and a secondary compartment region 108-1 to 108-3, positioned on the pillow case 100 top surface, comprising a plurality of individual proximally disposed secondary compartments (at least two, with three compartments 106-1 to 106-3 being illustrated by way of example only) positioned therein, with the primary compartment 102 being operable to receive through an opening 106 and releaseably retain therein any primary insert component (such as an appropriately sized conventional pillow (or equivalent similarly shaped soft and/ or resilient article)), and with each plural secondary compartment 106-1 to 106-3 being selectively operable to receive, and retain therein, at least one corresponding secondary insert component (such as a memory foam, latex, resilient material filled, inflatable, or other type of resilient article), such as at least one insert component 120-1 to 120-3, wherein: in a view V1, all three exemplary plural secondary compartments 106-1 to 106-3 are shown, by way of example, with corresponding plural secondary insert components 120-1 to 120-3, disposed therein; and in a view V2, the three exemplary plural secondary compartments 106-1 to 106-3 are shown, by way of example, with corresponding plural secondary inserts 120-1 and 120-2 disposed in only two of the three plural secondary compartments.

Figure 3B:
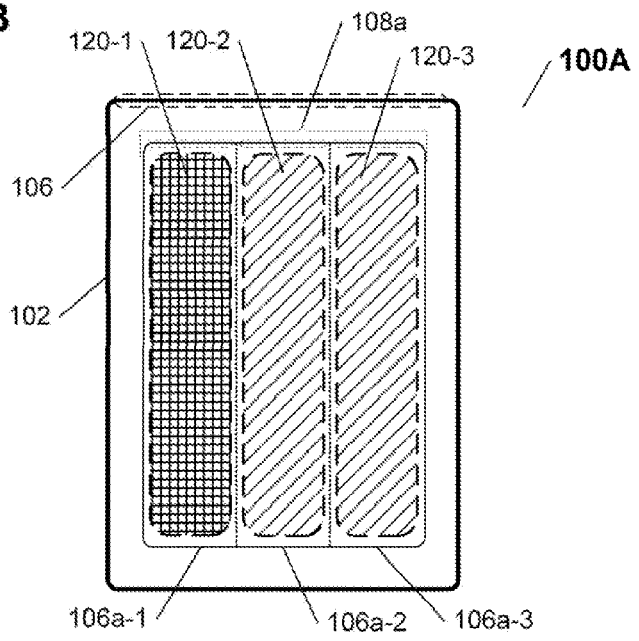
FIG. 3B is a schematic top-down view diagram of an alternative embodiment of the inventive configurable pillow case of FIG. 3A, with an internally disposed primary compartment, and a multi-section secondary compartment positioned on the pillow case top surface, comprising a plurality of secondary compartments (at least two, with three being illustrated by way of example only) internally disposed therein, with the primary compartment being operable to receive and releaseably retain therein any primary insert component (such as an appropriately sized conventional pillow (or equivalent similarly shaped soft and/or resilient article)), and with each plural secondary compartment being selectively operable to receive and retain at least one corresponding secondary insert component (such as a memory foam, latex, resilient material filled, inflatable, or other type of resilient article)

Referring now to FIG. 3B, a schematic top-down view diagram of an alternative embodiment of the inventive configurable pillow case 100 of FIG. 3A, is shown as a configurable pillow case 100A with an internally disposed primary compartment 102, and a multi-section secondary compartment 108*a* positioned on the pillow case top surface, comprising a plurality of secondary compartment sections (at least two, with three compartment sections 106*a*-1 to 106*a*-3 being illustrated by way of example only) internally disposed therein, with the primary compartment 102 being operable to receive and releaseably retain therein any primary insert component (such as an appropriately sized conventional pillow (or equivalent similarly shaped soft and/or resilient article)) through an opening 106, and with each plural secondary compartment section 106*a*-1 to 106*a*-3 being selectively operable to receive and retain at least one corresponding secondary insert component 120-1 to 120-3 (such as a memory foam, latex, resilient material filled, inflatable, or other type of resilient article).

Figure 4:
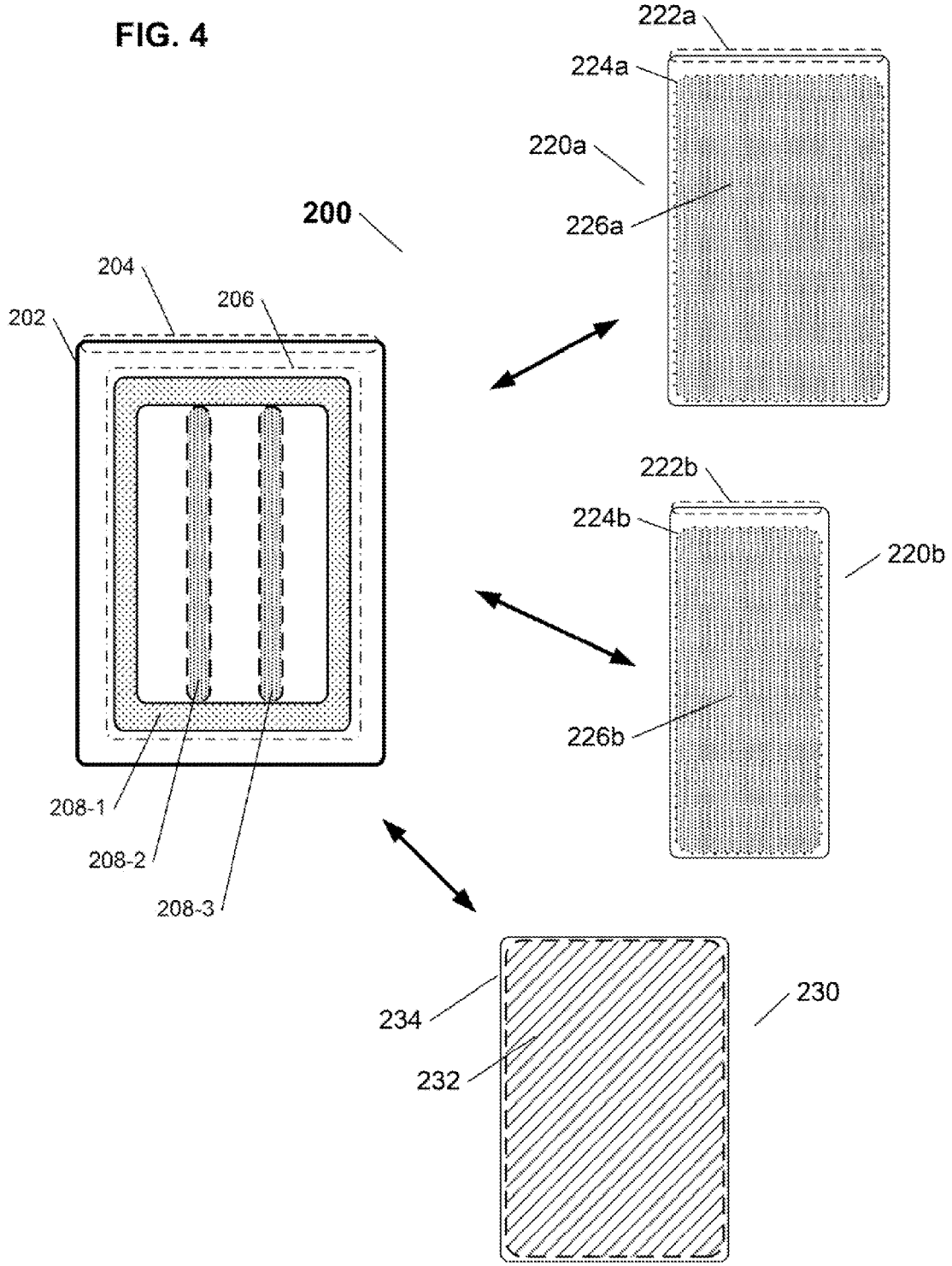
FIG. 4 is a schematic top-down view diagram of a third exemplary embodiment of the inventive configurable pillow case, with an internally disposed primary compartment, and a secondary compartment attachment region positioned on the pillow case top surface, comprising a predefined pattern of releasable attachment elements operable to selectively and releaseably connect to, and retain, at least one separate secondary compartment (empty and/or supplied with an internally disposed predefined secondary insert component), supplied with corresponding attachment elements positioned thereon, with the primary compartment being operable to receive and releaseably retain therein any primary insert component (such as an appropriately sized conventional pillow (or equivalent similarly shaped soft and/or resilient article)), and with each separate at least one secondary compartment being selectively operable to receive, and retain therein, at least one corresponding secondary insert component (such as a memory foam, latex, resilient material filled, inflatable, or other type of resilient article)

Referring now to FIG. 4, a schematic top-down view diagram of a third exemplary embodiment of the inventive configurable pillow case, is shown as a configurable pillow case 200, with an internally disposed primary compartment 202, and a secondary compartment attachment region 206 positioned on the pillow case 200 top surface, comprising a predefined pattern of at least one releasable attachment elements (up to three such elements 208-1 to 208-3 are shown by way of example), operable to selectively and releaseably connect to, and retain, at least one separate secondary compartment 220*a* (that may be provided empty and/or supplied with an internally disposed predefined secondary insert component 224*a*), comprising corresponding attachment elements 226*a* positioned thereon operable to releasably connect to elements 208-1 to 208-3, for example if configured with hook and loop materials, with the primary compartment 202 being operable to receive and releaseably retain therein any primary insert component (such as an appropriately sized conventional pillow (or equivalent similarly shaped soft and/or resilient article)) through an opening 204. The separate at least one secondary compartment 220*a* is selectively operable to receive, and retain therein through an opening 222*a*, at least one corresponding secondary insert component 224*a* (such as a memory foam, latex, resilient material filled, inflatable, or other type of resilient article). Alternately, the inventive releasably attachable secondary compartment 220*a* may comprise a different size and/or shape compartment 220*b*, with correspondingly sized attachment elements 226*b* positioned on the underside thereof, and having a corresponding insert 224*b* positioned therein. Alternately, instead of a secondary compartment 220*a*, an integrated comfort component 230, which comprises a secondary insert component 232 covered in a material that is configurable to releasably attach to the releasable attachment elements 208-1 to 208-3 of the pillow case 200.

Figure 5A:
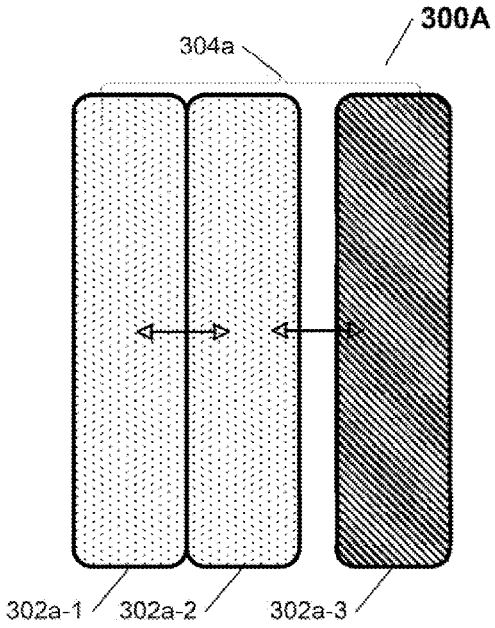
FIG. 5A is a schematic top-down view diagram of a first exemplary embodiment of the inventive secondary insert component for use in conjunction with any of the various embodiments of the inventive configurable pillow case of FIGS. 1A to 4, shown as a modular secondary insert component comprising a plurality of proximal insert modules (with three being shown by way of example only), each plural insert module comprising at least one releasable attachment element that is selectively operable for releasable attachment of the insert module to at least one other plural insert module (thus enabling the novel modular secondary insert component to be configured in a variety of different desired arrangements, prior to insertion thereof into one or more of the corresponding secondary compartment(s) of the various embodiments of the configurable pillow case of the present invention.

Referring now to FIG. 5A, a schematic top-down view diagram of a first exemplary embodiment of the inventive secondary insert component for use in conjunction with any of the various embodiments of the inventive configurable pillow case of FIGS. 1A to 4, is shown as a modular secondary insert component 300A, comprising a plurality of proximal insert modules 304*a* (with three modules being shown by way of example only), each plural insert module comprising at least one releasable attachment element 302*a*-1 to 302*a*-3 that is selectively operable for releasable attachment of each insert module to at least one other plural insert module (thus enabling the novel modular secondary insert component 300 to be configured in a variety of different desired arrangements, prior to insertion thereof into one or more of the corresponding secondary compartment(s) of the various embodiments of the configurable pillow case of the present invention.

Figure 5B:
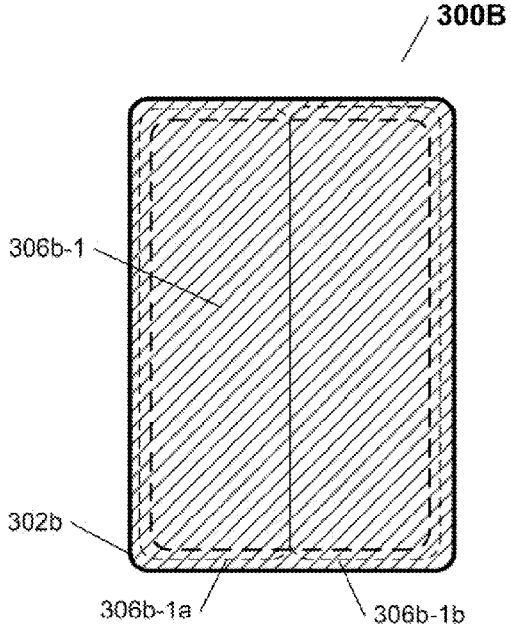
FIG. 5B is a schematic top-down view diagram of a second exemplary embodiment of the inventive secondary insert component for use in conjunction with any of the various embodiments of the inventive configurable pillow case of FIGS. 1A to 4, shown as a secondary insert component comprising a plurality of predefined regions, each having different physical characteristics, parameters, and/or predefined function(s), sized and configured for insertion thereof into one or more of the corresponding secondary compartment(s) of the various embodiments of the configurable pillow case of the present invention.

Referring now to FIG. 5B, a schematic top-down view diagram of a second exemplary embodiment of the inventive secondary insert component for use in conjunction with any of the various embodiments of the inventive configurable pillow case of FIGS. 1A to 4, shown as a secondary insert component 300B, comprising a plurality of predefined regions and/or compartments 302*b* to 306*b*-1*b*, each having different physical characteristics, parameters, and/or predefined function(s), sized and configured for insertion thereof into one or more of the corresponding secondary compartment(s) of the various embodiments of the configurable pillow case of the present invention.

Figure 5C:
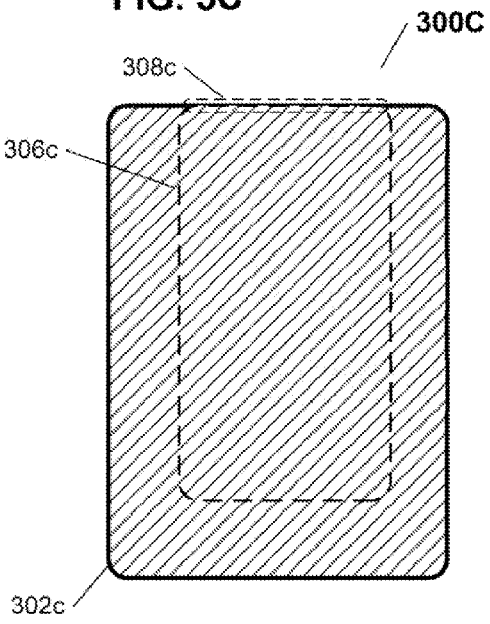
FIG. 5C is a schematic top-down view diagram of a third exemplary embodiment of the inventive secondary insert component for use in conjunction with any of the various embodiments of the inventive configurable pillow case of FIGS. 1A to 4, shown as a secondary insert component comprising at least one hollow internal cavity accessible by a user, operable to receive one or more appropriately sized and shaped articles therein, while enabling the novel secondary insert component to substantially maintain its outer shape and dimensions sufficiently to permit the insertion thereof into one or more of the corresponding secondary compartment(s) of the various embodiments of the configurable pillow case of the present invention.

Referring now to FIG. 5C, a schematic top-down view diagram of a third exemplary embodiment of the inventive secondary insert component for use in conjunction with any of the various embodiments of the inventive configurable pillow case of FIGS. 1A to 4, shown as a secondary insert component 300C comprising a body 302*c* having at least one hollow internal cavity 306*c* accessible by a user through an opening 308*c*, operable to receive one or more appropriately sized and shaped articles therein (through the opening 308*c*), while enabling the novel secondary insert component 300A to substantially maintain its outer shape and dimensions sufficiently to permit the insertion thereof into one or more of the corresponding secondary compartment(s) of the various embodiments of the configurable pillow case of the present invention.

Figure 5D:
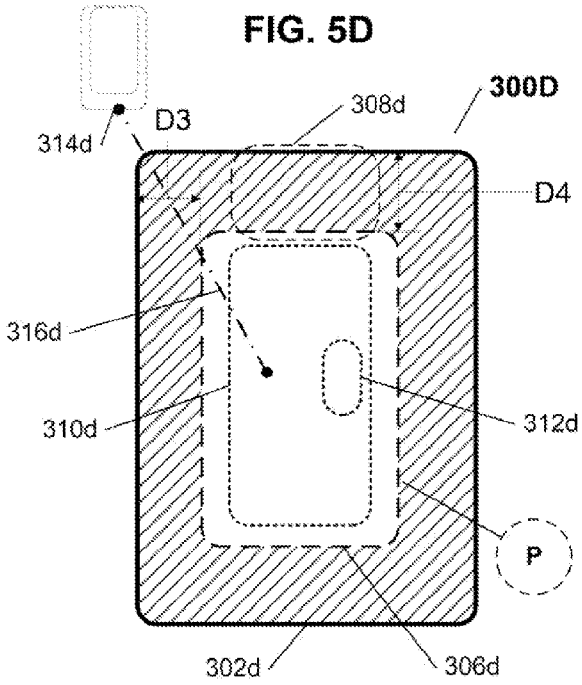
FIG. 5D is a schematic top-down view diagram of an alternative exemplary embodiment of the secondary insert component of FIG. 5C, for use in conjunction with any of the various embodiments of the inventive configurable pillow case of FIGS. 1A to 4, comprising at least one hollow internal cavity therein, and further comprising at least one functional element disposed therein, that is selectively operable (by a user and/or automatically) to perform one or more predefined functions, each function being controllable by: (a) at least one corresponding local control element positioned within and/or on the secondary insert component (configured for direct and/or automatic control of the predefined function(s)), (b) by a remote control located outside of the secondary insert component; and/or (c) by a data processing device (such as a mobile communication device (e.g., smart phone), and or a portable or desktop computer) through a wireless communication link, wherein each at least one functional element (and, if applicable, at least one control element) is sized and configured to enable the novel secondary insert component to substantially maintain its outer shape and dimensions sufficiently to permit the insertion thereof into one or more of the corresponding secondary compartment(s) of the various embodiments of the configurable pillow case of the present invention.

Referring now to FIG. 5D, a schematic top-down view diagram of an alternative exemplary embodiment of the secondary insert component 300C of FIG. 5C, is shown as a inventive secondary insert component 300D for use in conjunction with any of the various embodiments of the inventive configurable pillow case of FIGS. 1A to 4, comprising a body 302*d* having at least one hollow internal cavity 306*d* therein, and further comprising at least one functional element 310*d* disposed therein, that is selectively operable (by a user and/or automatically) to perform one or more predefined functions, each function being controllable by: (a) at least one corresponding local control element 312*d* positioned within and/or on the secondary insert component (configured for direct and/or automatic control of the predefined function(s)), (b) by a remote control P located outside of the secondary insert component 300D; and/or (c) by a data processing device 314*d* (such as a mobile communication device (e.g., smart phone), and or a portable or desktop computer) through a wireless communication link 316*d*, wherein each at least one functional element 310*d* (and, if applicable, at least one control element 312*d*) is sized and configured (for example at least through selection of dimensions D3 and D4), to enable the novel secondary insert component 300D to substantially maintain its outer shape and dimensions sufficiently to permit the insertion thereof into one or more of the corresponding secondary compartment(s) of the various embodiments of the configurable pillow case of the present invention.

Optionally an opening in the insert body 302*d*, enabling access to the internal cavity 306*d*, may comprise a removable insert 308*d* that enables the at least one functional element 310*d* to be retained within the internal cavity 306*d* during use of the secondary insert component 300D, but to be easily removed when desired by first removing the insert 308*d*.

Thus, while there have been shown and described and pointed out fundamental novel features of the inventive system and method as applied to preferred embodiments thereof, it will be understood that various omissions and substitutions and changes in the form and details of the devices and methods illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

I claim:

1. A configurable pillow case article comprising an upper exterior region and a lower exterior for use with a primary resilient insert, and at least one secondary insert, comprising:

a pillow case housing having a top section of a first surface area size comprising a first top surface composed of a first material and a second top surface composed of a second material, a bottom section comprising a first bottom surface composed of said second material and a second bottom surface composed of said first material, and a plurality of side edges;

a primary compartment, disposed within said pillow case housing, between said top section and said bottom section, sized and configured to receive the primary insert therein; and at least one secondary compartment composed of a third material, positioned in at least one predetermined region of said pillow case housing top section on said first top surface, each configured to receive, and releaseably retain therein, the at least one secondary insert, wherein said pillow case is operable in a first configuration in which the pillow case upper exterior region comprises said first top surface of said top section, and said pillow case lower exterior region comprises said second bottom surface of said bottom section, such that in said first configuration, both the upper and the lower exterior regions are composed of said first material, and said at least one secondary compartment is disposed on said upper exterior region, and wherein said pillow case is further operable in a second configuration in which said pillow case housing is inverted so that the pillow case upper exterior region comprises said second top surface of said top section, and said pillow case lower exterior region comprises said first bottom surface of said bottom section, such that in said second configuration, both the upper and the lower exterior regions are composed of said second material, and said at least one secondary compartment is disposed inside said pillow case housing, proximal to said primary compartment.

2. The configurable pillow case article of claim 1, wherein the primary insert comprises a pillow, and wherein the at least one secondary insert comprises at least one of: a memory foam component, a latex foam component, a memory gel component, a granular mixture, at least one inflatable air bladder, a rubberized component, a selectively shapeable material component, a feather filled component, a down filled component, and a resilient material component or assembly.

3. The configurable pillow case article of claim 1, wherein said first material is selected from a first group of materials comprising conventional pillow case fabrics, and wherein said second material is selected from a second group of materials comprising a rugged material.

4. The configurable pillow case article of claim 1, wherein said at least one secondary compartment comprises a plurality of secondary compartments positioned at different regions of said top section proximally to one another, each said plural secondary compartment being operable to receive one of the at least one secondary inserts, thus enabling customizable configuration of the pillow case by selection of a quantity and of positioning of said at least one secondary inserts.

5. The configurable pillow case article of claim 1, wherein said first material is selected from a first group of materials comprising conventional pillow case fabrics, and and wherein said second material is selected from a second group of materials comprising a rugged material.

6. A configurable pillow case article comprising an upper exterior region and a lower exterior region, for use with a primary resilient insert, and at least one secondary insert, comprising:

a pillow case housing having a top section of a first surface area size comprising a first top surface composed of a first material and a second top surface composed of a second material, a bottom section comprising a first bottom surface composed of one of said first and said second materials and a second bottom surface composed of said second material, and a plurality of side edges wherein said second material comprises a protective resilient fabric;

a primary compartment, disposed within said pillow case housing, between said top section and said bottom section, sized and configured to receive the primary insert therein; and at least one secondary compartment composed of said first material, positioned in at least one predetermined region of said pillow case housing top section on said first top surface, each configured to receive, and releaseably retain therein, the at least one secondary insert, wherein said pillow case is operable in a first configuration in which the primary insert is disposed within said primary compartment and in which the pillow case upper exterior region comprises said first top surface of said top section, and said pillow case lower exterior region comprises said second bottom surface of said bottom section, such that in said first configuration, the upper exterior region is composed of said first material, while the bottom exterior region is composed of said second material and said at least one secondary compartment is disposed on said upper exterior region, and wherein said pillow case is further operable in a second configuration in which the primary insert is removed from said primary compartment, and in which said pillow case housing is at least one of: folded and rolled-up so that both of the pillow case upper and lower exterior regions comprise said second bottom surface of said bottom section, such that in said second configuration both of the pillow case upper and lower exterior regions are composed of said second material.

7. The configurable pillow case article of claim 6, further comprising a releasable retaining component, positioned on said second bottom surface of said bottom section operable to releasably retain said pillow case housing in said second configuration.

8. The configurable pillow case article of claim 6, for use with a primary resilient insert, and at least one secondary insert, wherein the at least one secondary compartment comprises a plurality of secondary compartments positioned at different regions of said top section proximally to one another, each said plural secondary compartment being operable to receive, and to releasably retain therein, one of the at least one secondary inserts, thus enabling customizable configuration of the pillow case by selection of a quantity and of positioning of said at least one secondary inserts.

9. The configurable pillow case article of claim 8, wherein said at least one secondary insert comprises a plurality of secondary inserts and wherein at least one of said plural secondary inserts is composed of a different material than at least one other of said plural secondary inserts.

* * * * *